US005489251A

United States Patent [19]

Robles, Jr.

[11] Patent Number: 5,489,251

[45] Date of Patent: Feb. 6, 1996

[54] EXERCISE DEVICE

[76] Inventor: Sherman U. Robles, Jr., 1501 Green Acres Rd., Metairie, La. 70003

[21] Appl. No.: 386,004

[22] Filed: Feb. 9, 1995

[51] Int. Cl.[6] ..... A63B 23/08; A63B 21/02

[52] U.S. Cl. ..... 482/79; 482/124

[58] Field of Search ..... 482/79, 121, 122, 482/124, 128, 139, 126

[56] References Cited

U.S. PATENT DOCUMENTS

| | | | |
|---|---|---|---|
| 2,467,943 | 4/1949 | Mikell, Jr. . | |
| 2,966,905 | 1/1961 | Kamenshine . | |
| 4,371,161 | 2/1983 | Williams . | |
| 4,606,542 | 8/1986 | Segal . | |
| 4,669,722 | 6/1987 | Rancaswamy | 482/79 |
| 4,930,767 | 5/1990 | Hamm | 482/124 |
| 4,998,722 | 3/1991 | Scott | 482/79 |
| 5,013,037 | 5/1991 | Stermer | 482/122 |
| 5,062,642 | 11/1991 | Berry et al. | 482/122 |
| 5039,093 | 8/1991 | Collier | 482/79 |
| 5,203,754 | 4/1993 | Maclean . | |
| 5,236,333 | 8/1993 | Barba, Jr. . | |
| 5,256,119 | 9/1993 | Tudor . | |

FOREIGN PATENT DOCUMENTS

| | | | |
|---|---|---|---|
| 0480383 | 7/1916 | France | 482/121 |
| 1611353 | 12/1990 | U.S.S.R. | 482/124 |
| 1659074 | 6/1991 | U.S.S.R. | 482/79 |

*Primary Examiner*—Lynne A. Reichard
*Attorney, Agent, or Firm*—Joseph N. Breaux

[57] ABSTRACT

An exercise device having a foot harness securable about a foot of a user; a thigh harness having a rigid plate member securable about a thigh of a user; and a tension adjusting mechanism connected between the foot harness and the thigh harness. The tension adjusting mechanism includes a tubular housing having an elongated passageway formed therethrough terminating in a first and second housing end; a spring plate, slidably disposed within the passageway, having a first and second plate side; a spring having a first and second spring end; a flexible, fixed length, tension member having a first and second tension member end; and a positioning member in connection with the spring plate for allowing the user to selectively position the spring plate in a desired position within the passageway.

20 Claims, 2 Drawing Sheets

EXERCISE DEVICE

TECHNICAL FIELD

The present invention relates to devices for exercising and more particularly to devices for providing resistance training and isolating the calf muscles.

BACKGROUND ART

In the hectic everyday life of many people it is difficult to find either the time or the motivation to exercise. Exercise regimens are also avoided due to the expense and hassle of joining a gym. In an effort to avoid the expense and hassle of gyms many people opt to exercise at home. However, home exercise regimens are limited by the space available and the expense of purchasing individual pieces of equipment.

Due to this dilemma many people either do not exercise at all or only perform a few isometric exercises which isolate certain muscle groups. One of the most popular muscle groups to isolate and exercise, for aesthetic reasons among others, are calf muscles. Unfortunately, calf muscles do not respond as well to isometric exercises as they do with resistance exercising.

It would be a benefit, therefore, to have a exercise device which is light weight and easy to use at home. It would be a further benefit to have a exercise device which is inexpensive. It would be a further benefit to have a exercise device which allows for variable resistance training of the calf muscles.

GENERAL SUMMARY DISCUSSION OF INVENTION

It is thus an object of the invention to provide a exercise device that provides variable resistance loading to the calf muscles.

It is a still further object of the invention to provide a exercise device which may be used as a modality to isolate calf muscles and to perform toe raises.

It is a still further object of the invention to provide a exercise device in which movement patterns are low impact and non-ballistic.

Accordingly, an exercise device for exercising the calf muscles having a foot harness securable about a foot of a user, a thigh harness having a rigid plate member securable to a thigh of a user and a tension adjusting mechanism, having a positioning mechanism, a spring and a fixed length tension member, connected between the foot harness and the thigh harness is provided.

To use the exercise device, the thigh harness is snugly secured to the user's thigh and, with the leg extended, the user's foot is placed into the foot harness. The positioning mechanism is then used to adjust the tension adjusting mechanism so that, when the user's leg is extended and the calf muscle is relaxed, the spring is in tension. When the foot is extended the spring provides a resistive force to the movement, thus, exercising the calf muscles. The positioning mechanism may then be used to move the spring in relation to the thigh harness increasing or decreasing the tension in the spring, varying the exercise intensity.

The tension adjusting mechanism preferably includes a tubular housing, having a passageway entrapping a spring plate. One end of the spring is tensionally connected to a first side of the spring plate, the other end of the spring is tensionally connected to an end of the fixed length tension member. The positioning mechanism is connected to the second side of the spring plate. The term "tensionally connected" is used herein to mean a connection that allows a tensional force to be transferred between the two connected members.

The positioning mechanism may be any device known in the art which allows the user to move the spring in relation to the thigh harness to increase or decrease the tension in the spring and thus varying the exercise intensity. The positioning mechanism is preferably swivelly connected to the spring plate preventing the spring from twisting. The positioning mechanism is preferably a screw type device.

The foot harness may be any device known in the art which entraps the user's foot in a manner such that a force may be exerted against the device extending the spring.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
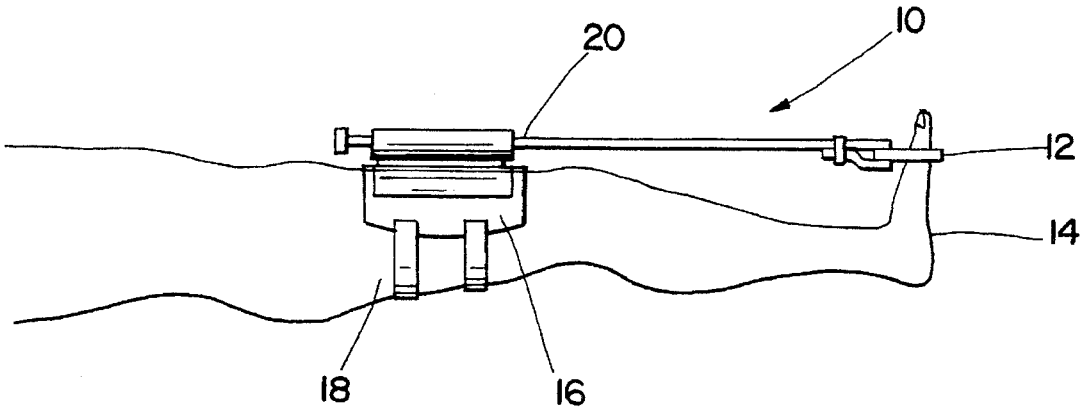
FIG. 1 is a side view of an exemplary embodiment of the exercise device.

FIG. 1 is a side view of an exemplary embodiment of the exercise device of the present invention generally designated by the numeral 10. Exercise device 10 includes a foot harness 12 securable about a foot 14 of a user, a thigh harness 16 securable to a thigh 18 of the user and an tension adjusting mechanism 20.

Figure 2:
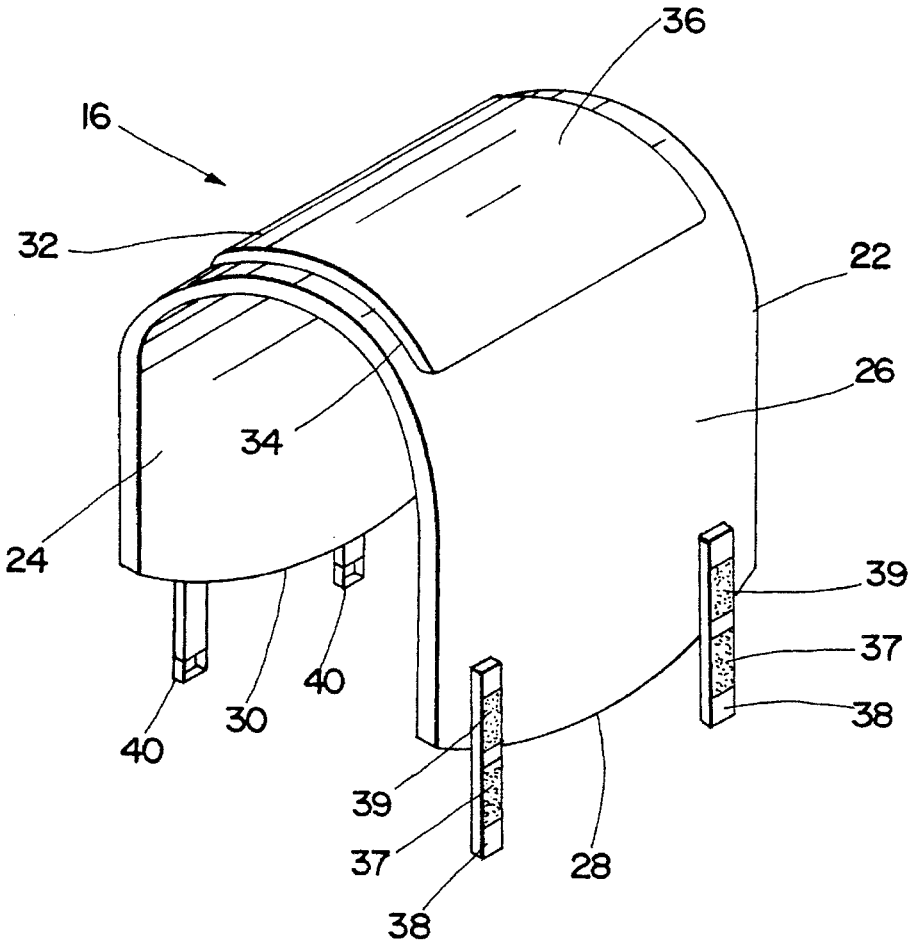
FIG. 2 is an isometric view of the thigh harness.

FIG. 2 is an isometric view of thigh harness 16. The figure shows a wrapping member 22 having a first surface 24, a second surface 26, a first wrapping end 28 and a second wrapping end 30. Wrapping member 22 is constructed of a flexible rubber material. A rigid plate member 32 is a curved shaped polyvinyl chloride (PVC) member having a concave surface 34, centered on and connected by glueing to second surface 26, and a seating surface 36.

Two fastening straps 38 having a hook section 37 and a pile section 39, oriented parallel to each other, extend vertically from first wrapping end 28 and are connected by sewing to second surface 26. Two latches 40 extend vertically from second wrapping end 30 and are connected by sewing to second surface 26.

In use, first surface 24 contacts the user's thigh with rigid plate member 32 longitudinally aligned along the top portion of the user's thigh. Fastening straps 38 interconnect with latches 40 in a manner such that wrapping member 22 snugly entraps the user's thigh.

Figure 3:
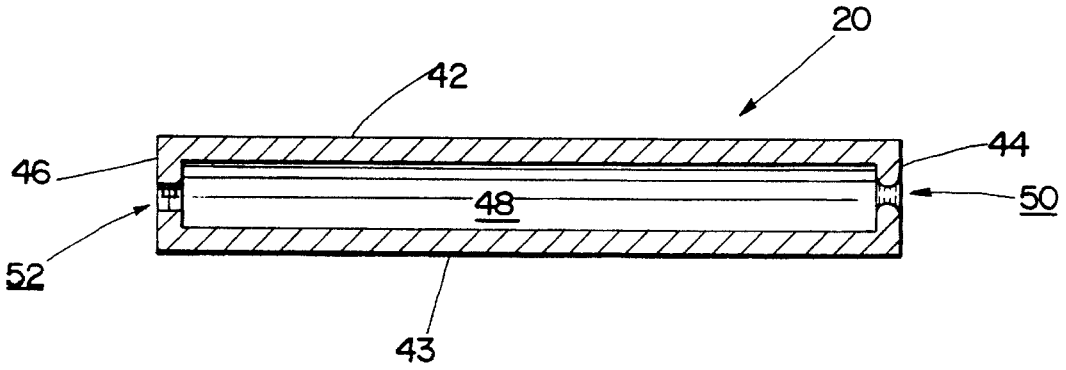
FIG. 3 is a cross-sectional view of the tubular housing which forms a portion of the tension adjusting mechanism.

FIG. 3 is a cross-sectional view of a PVC tubular housing 42, having a first and second housing end 44,46 connected by a passageway 48, which forms a portion of tension adjusting mechanism 20. First housing end 44 has a rounded tension member aperture 50 formed therethrough. Second housing end 46 has a internally threaded rod aperture 52 formed therethrough. Tubular housing 42 has an exterior surface 43 rigidly connected to seating surface 36 (FIG. 2) by glueing, the first housing end being oriented towards foot 14 (FIG. 1) of the user.

Figure 4:
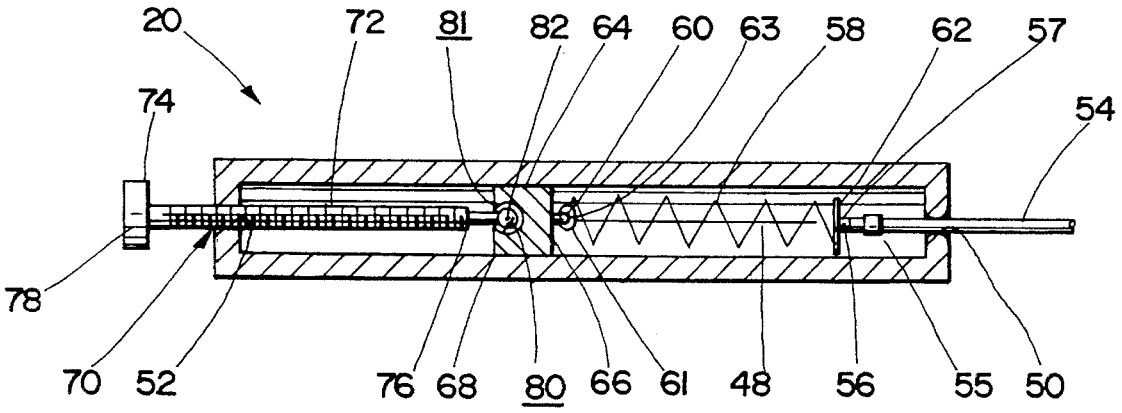
FIG. 4 is a cross-sectional view of the tension adjusting mechanism.

FIG. 4 is a cross-sectional view of tension adjusting mechanism 20. The figure shows tension member 54 having a first tension member end 56 and a second tension member end 92 (not shown), a spring 58 having a first spring end 60 and a second spring end 62, a spring plate 64 having a first plate side 66 and a second plate side 68 having a socket 80 formed therein, and a positioning mechanism generally designated as 70.

Positioning mechanism 70 includes an elongated rod 72, companionately threaded with rod aperture 52, having a first rod end 74 and a second rod end 76, a handle 78 is connected by welding to first rod end 74, a ball member 82 is connected by welding to second rod end 76.

Tension member 54 is disposed through tension member aperture 50. First tension member end 56 is connected by a clamp 55 to second spring end 62 through a first spring loop 57. First spring end 60 is connected to first plate side 66 by passing a hook 63 through a second spring loop 61. Spring plate 64 is slidably entrapped within passageway 48. Spring plate 64 forms a socket 82 with an opening 81 on second plate side 68. Socket 82 rotatably entraps ball 80. Rotating handle 78 causes elongated rod 72 to move relative to housing 42 displacing spring plate 64 longitudinally through passageway 48.

Figure 5:
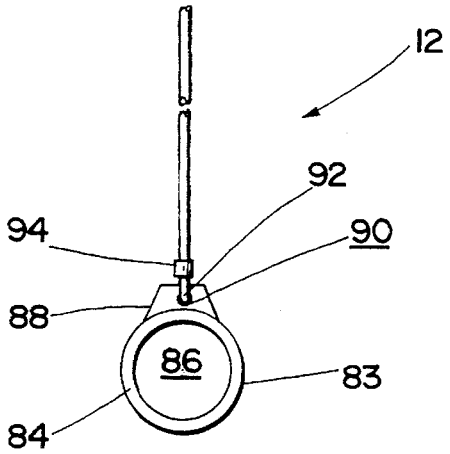
FIG. 5 is a horizontal view of the foot harness.

FIG. 5 is a horizontal view of foot harness 12. The figure shows a flexible member 84 forming a foot aperture 86 having a cross-sectional diameter sufficient to accommodate a foot wearing an athletic shoe and a rigid foot harness bracket 88. Foot harness 84 has an outside surface 83. Foot harness bracket 88 forms a harness aperture 90.

Foot harness bracket 88 is connected to outside surface 83 by glueing. Second tension member end 92 passes through harness aperture 90 and is secured by clamp 94.

Use of exercise device 10 is now described with reference to FIGS. 1–5. Exercising the calf muscles with exercise device 10 is as simple as extending your foot. The calf muscles are exercised by securely strapping the thigh harness 16 to a thigh 18 and inserting a foot 14 through the foot harness 12. When foot 14 is extended a resistive force is encountered exercising the calf muscles. By displacing spring plate 64 longitudinally along passageway 48 the tension in spring 58 is changed varying the intensity of the exercise.

It can be seen from the preceding description that a device for exercising which provides variable resistance loading, which may be used as a modality to isolate calf muscles and to perform toe raises, and in which movement patterns are low impact and non-ballistic has been provided.

It is noted that the embodiment of the exercise device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An exercise device comprising:

a foot harness securable about a foot of a user;

a thigh harness having a rigid plate member securable about a thigh of the user; and a tension adjusting mechanism connected between said foot harness and said thigh harness;

said tension adjusting mechanism comprising:

a tubular housing having an elongated passageway formed therethrough terminating in a first and second housing end;

a spring plate slidably disposed within said passageway having a first and second plate side;

a spring having a first and second spring end;

a flexible, fixed length, tension member having a first and second tension member end; and positioning means, in connection with said spring plate, for allowing the user to selectively secure said spring plate in a desired position within said passageway;

said tubular housing being rigidly attached to said rigid plate member, said first spring end being tensionally connected to said first plate side, said second spring end being tensionally connected to said first tension member end, said second tension member end being tensionally connected to said foot harness, said first housing end having a tension member aperture formed therethrough, said flexible tension member being disposed through said tension member aperture.

2. The exercise device of claim 1, wherein:

said positioning means includes a screw mechanism in connection with said spring plate in a manner such that a user may selectively position said spring plate in a desired position within said passageway by rotating a portion of said screw mechanism.

3. The exercise device of claim 2, wherein:

said positioning means further includes an elongated rod having a first and a second rod end, said elongated rod having a threaded portion; and a handle connected to said first rod end.

4. The exercise device of claim 3, wherein:

said second housing end has a rod aperture formed therethrough; and said elongated rod is disposed through said rod aperture.

5. The exercise device of claim 4, wherein:

said spring plate includes a threaded aperture centered thereon and formed therethrough, said spring plate is threaded onto said second rod end; and a stop plate is connected between said second rod end and said first plate side of said spring plate in a manner such that said spring plate is maintained on said elongated rod.

6. The exercise device of claim 5, wherein:

said tension member aperture is rounded in a manner such that no right angles contact a portion of said tension member disposed through said tension member aperture.

7. The exercise device of claim 6, wherein:

said thigh harness includes a flexible wrapping member having a first surface, adapted for entrapping said thigh of the user; and a second surface in connection with said rigid plate member.

8. The exercise device of claim 7, wherein:

said thigh harness further includes fastening means in connection with said flexible wrapping member for allowing the user to securely fasten said thigh harness about said thigh of the user.

9. The exercise device of claim 8, wherein:

said fastening means includes a hook and pile fastener extending from a first wrapping end of said flexible wrapping member and a latch extending from a second wrapping end of said flexible wrapping member; said hook and pile fastener being interconnectable with said latch.

10. The exercise device of claim 3, wherein:

said second housing end includes an internally threaded rod aperture formed therethrough; and said elongated rod is companionately threaded with said rod aperture and said elongated rod is threaded into said rod aperture.

11. The exercise device of claim 10, wherein:

said spring plate has a sliding aperture centered and formed therethrough;

said second rod end is rotatably disposed through said sliding aperture; and a nut is fastened to said second rod end in a manner such that said spring plate is maintained on said elongated rod.

12. The exercise device of claim 11, wherein:

said spring plate further includes a first and a second hanging aperture adjacent and aligned with said sliding aperture; and said positioning means further includes a U-shaped bolt having a first and a second threaded end, and a first and a second nut companionately threaded with said first and second threaded end;

said first threaded end being disposed through said first hanging aperture, said second threaded end being disposed through said second hanging aperture, said first spring end being tensionally connected to said U-shaped bolt, said first threaded nut being threaded onto said first threaded end, and said second threaded nut being threaded onto said second threaded end.

13. The exercise device of claim 12, wherein:

said tension member aperture is rounded in a manner such that no right angles contact a portion of said tension member disposed through said tension member aperture.

14. The exercise device of claim 13, wherein:

said thigh harness includes a flexible wrapping member having a first surface adapted for entrapping said thigh of the user and a second surface in connection with said rigid plate member.

15. The exercise device of claim 14, wherein:

said thigh harness further includes fastening means in connection with said flexible wrapping member for allowing the user to securely fasten said thigh harness about said thigh of the user.

16. The exercise device of claim 15, wherein:

said fastening means includes at least one hook and pile fastener extending from a first wrapping end of said flexible wrapping member and at least one latch extending from a second wrapping end of said flexible wrapping member;

said hook and pile fastener being interconnectable with said latch.

17. The exercise device of claim 2, wherein:

said positioning means includes:

an elongated rod having a first and a second rod end, said elongated rod having a threaded portion;

a handle; and a ball joint member; and wherein:

said second housing end has an internally threaded rod aperture formed therethrough;

said spring plate has a socket formed therein open to said second plate side;

said handle is connected to said first rod end, said ball joint member is connected to said second rod end, said elongated rod is companionately threaded with said rod aperture, said elongated rod is threaded into said rod aperture, said socket rotatably entrapping said ball joint member in a manner such that when said handle is rotated said spring plate is longitudinally displaced along said passageway.

18. The exercise device of claim 17, wherein:

said tension member aperture is rounded in a manner such that no right angles contact a portion of said tension member disposed through said tension member aperture.

19. The exercise device of claim 18, wherein:

said thigh harness includes a flexible wrapping member having a first surface adapted for entrapping said thigh of the user and a second surface in connection with said rigid plate member; and fastening means in connection with said flexible wrapping member for allowing the user to securely fasten said thigh harness about said thigh of the user.

20. An exercise device comprising:

a foot harness securable about a foot of a user, said foot harness having a rigid foot bracket forming a harness aperture therethrough;

a thigh harness having a flexible wrapping member, means for fastening said thigh harness to a thigh of the user and a rigid plate member; and a tension adjusting mechanism connected between said foot harness and said thigh harness;

said tension adjusting mechanism comprising:

a tubular housing having an elongated passageway formed therethrough terminating in a first and second housing end;

a spring plate slidably disposed within said passageway having a first and second plate side;

a spring having a first and second spring end;

a flexible, fixed length, tension member having a first and second tension member end; and positioning means, in connection with said spring plate, for allowing the user to selectively position said spring plate in a desired position within said passageway; said positioning means comprising:

an elongated rod having a first and a second rod end, said elongated rod having a threaded portion;

a handle; and a ball joint member;

said tubular housing being rigidly connected to said rigid plate member, said first spring end being tensionally connected to said first plate side, said second spring end being tensionally connected to said first tension member end, said first housing end having a rounded tension member aperture formed therethrough, said flexible tension member being disposed through said rounded tension member aperture in a manner such that no right angles contact a portion of said tension member, said second tension member end being disposed through said harness aperture and tensionally connected to said foot harness;

said handle is connected to said first rod end, said ball joint member is connected to said second rod end, said second housing end has an internally threaded rod aperture centered and formed therethrough, said elongated rod is threaded into said rod aperture, said spring plate has a socket formed therein open to said second plate side, said socket rotatably entraps said ball joint member in a manner such that when said handle is rotated said spring plate is longitudinally displaced along said passageway.

* * * * *